US008668405B1

(12) United States Patent
Singleton

(10) Patent No.: US 8,668,405 B1
(45) Date of Patent: Mar. 11, 2014

(54) ROAD MAINTENANCE TRUCK WITH SELECTIVELY DEPLOYABLE ROLLERS AND PISTON PRESS

(76) Inventor: William Singleton, Wayne, MI (US)

( * ) Notice: Subject to any disclaimer, the term of this patent is extended or adjusted under 35 U.S.C. 154(b) by 114 days.

(21) Appl. No.: 13/463,639

(22) Filed: May 3, 2012

Related U.S. Application Data

(60) Provisional application No. 61/481,896, filed on May 3, 2011, provisional application No. 61/515,868, filed on Aug. 6, 2011.

(51) Int. Cl.
*E01C 19/26* (2006.01)

(52) U.S. Cl.
USPC ..... 404/128; 404/77; 404/79; 404/95; 404/122

(58) Field of Classification Search
USPC ..... 404/77, 79, 95, 117, 122–129, 132, 404/133.2
See application file for complete search history.

(56) References Cited

U.S. PATENT DOCUMENTS 2,559,417 A * 7/1951 Florio ..... 132/278
2,778,181 A * 1/1957 Gray ..... 404/86
3,873,228 A * 3/1975 Dunham ..... 404/128
4,193,710 A * 3/1980 Pietrowski ..... 404/128
4,423,980 A * 1/1984 Warnock ..... 404/83
4,676,689 A * 6/1987 Yant ..... 404/110
4,867,606 A * 9/1989 Wright ..... 405/182
5,088,855 A * 2/1992 Giliberti ..... 404/103
5,899,630 A * 5/1999 Brock ..... 404/79
6,354,761 B1 * 3/2002 Clements ..... 404/129
7,334,964 B1 * 2/2008 Brown et al. ..... 404/126
8,246,271 B2 * 8/2012 Verhoff ..... 404/117

* cited by examiner

*Primary Examiner* — Raymond W. Addie
(74) *Attorney, Agent, or Firm* — Vincent Re PLLC

(57) ABSTRACT

An improved road maintenance truck includes a pair of hydraulically powered roller assemblies mounted to the underside of the vehicle frame and a vertically movable compression plate mounted to the vehicle frame. Each roller assembly has a compressive roller which runs the width of the truck. Two hydraulic actuators on each end of the vehicle raise and lower the roller into place. These independent rollers allow a road patching crew to selectively lower the roller for repairing road while initially flattening the patching material with the front roller and compacting the patching material with the rear. The compression plate is mounted to an actuator which selectively raises and lowers the compression plate to compress road patching materials. A roller heating system draws engine coolant through the rollers to heat the rollers and to reduce the heat built-up in the engine.

9 Claims, 6 Drawing Sheets

ROAD MAINTENANCE TRUCK WITH SELECTIVELY DEPLOYABLE ROLLERS AND PISTON PRESS

CROSS-REFERENCE TO RELATED APPLICATIONS

This application claims priority of United States Provisional Patent Application filed May 3, 2011 having Ser. No. 61/481,896 and United States Provisional Patent Application filed Aug. 6, 2011 having Ser. No. 61/515,868.

FIELD OF THE INVENTION

This invention is related to road maintenance equipment and more particularly to a road maintenance vehicle having hydraulically deployed rollers which may be used in connection with the patching of road surfaces with asphalt materials.

BACKGROUND OF THE INVENTION

A variety of road maintenance equipment having various roller configurations has been previously disclosed to enable road crews to smooth or tamp down roadway patching materials, such as asphalt.

U.S. Pat. No. 2,778,181 issued to Gray and U.S. Pat. No. 5,088,855 issued to Giliberti both describe vehicle mounted rollers which move from a raised non-use position to a rolling position where the roller is engaged with both the ground and the drive wheel of the vehicle. In this manner, the weight of the vehicle provides the compression, while the drive train of the vehicle turns the roller to move the vehicle.

U.S. Pat. No. 2,559,417 issued to Hastings discloses a roller for a road work crew that is mounted to the dump body of the truck. To compact a surface, the dump body is raised to lower the roller against the ground.

U.S. Pat. No. 3,873,228 issued to Dunham, U.S. Pat. No. 4,193,710 issued to Pietrowski, and U.S. Pat. No. 6,354,761 issued to Clements each show a variation of coupling a roller to a hydraulically actuated snowplow lift mounted to a work truck. In these patents, the snowplow hydraulics mounted to the front of the vehicle lift and pivot the roller to position the roller.

While the prior art discussed above provide some solutions to the problem of providing road maintenance workers with a means to compact road patching materials, they do not provide a road-worthy system providing dual rollers to first flatten, then compact the patching material.

SUMMARY OF THE INVENTION

The broad purpose of the present invention is to provide a road maintenance vehicle, such as a dump truck, with a pair of selectively deployable rollers. The paired rollers cooperate to initially flatten (front roller) and then compact (rear roller) a road patching material, such as asphalt. The two rollers are mounted adjacent to the front and rear wheels and are hydraulically movable from a stowed position which is remote from the ground to a deployed position, where the rollers are lowered toward the ground. Further, an additional press plate is mounted upon the vehicle which can be raised and lowered to further tamp down the road patching material.

The present invention further provides a system for both heating at least one of the two deployable rollers and to provide additional cooling for the vehicle's prime mover by transferring coolant fluid from the vehicle's engine cooling system (i.e., the radiator) and pumps the engine-heated fluid through the roller or rollers.

In the preferred embodiment, each roller is mounted upon a pair of spaced arms, these arms are pivoted by hydraulic cylinders to raise and lower the rollers as desired.

It is an advantage of the present disclosure to provide a road maintenance vehicle including a truck having front and rear rubber road tires supported by a chassis with a truck frame and front and rear metal roller assemblies which are pivotally supported by the truck frame, each roller assembly having a rigid cylindrical roller which is movable from a stowed position where the roller is upwardly suspended from the ground to a deployed position where the roller is against the ground.

It is another advantage of the present invention to provide a road maintenance vehicle where the rear roller assembly is deployable vertically downward beyond the front roller assembly when both of the roller assemblies are in their deployed position.

It is still another advantage of the present invention to provide a road maintenance vehicle wherein the deployed position of the rear roller assembly is such that a portion of the weight of the truck vehicle is borne by the rear roller assembly, whereby a compressive force is applied by the rear roller upon road patching materials.

It is yet another advantage of the present invention to provide a road maintenance vehicle further including hydraulic pumps and linear hydraulic actuators mounted upon the truck vehicle. Wherein the hydraulic actuators are coupled to each of the front and rear roller assemblies and selectively move the roller assemblies between the stowed and deployed positions.

It is still yet another advantage of the present invention to provide a road maintenance vehicle wherein the front metal roller assembly is mounted adjacent to the front road tires and the rear metal roller assembly is mounted adjacent to the rear road tires.

Another advantage of the present invention is to provide a system for drawing heated coolant fluid from the maintenance vehicle's engine through at least one of the metal roller assemblies.

Still another advantage of the present invention to provide a road maintenance vehicle further including a rigid substantially flat plate that is pressed downward from the vehicle toward the ground.

Still further objects and advantages of the invention will become readily apparent to those skilled in the art to which the invention pertains upon reference to the following detailed description.

BRIEF DESCRIPTION OF THE DRAWINGS

The description refers to the accompanying drawings in which like reference characters refer to like parts throughout the several views and in which.

DETAILED DESCRIPTION OF THE INVENTION

Figure 1:
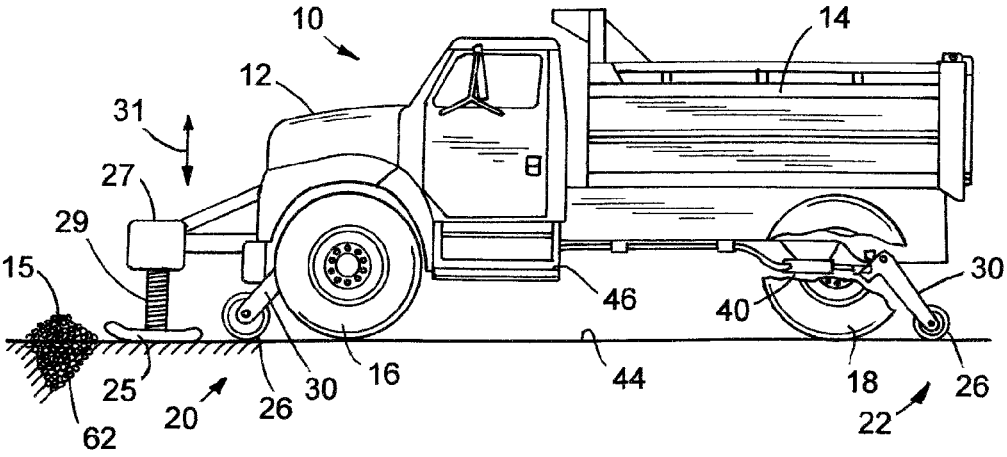
FIG. 1 is a side plan view illustrating a road maintenance vehicle embodying the invention with a compression plate mounted upon the front of the vehicle and with the roller assemblies deployed.

Referring now to the FIGS., an improved road maintenance vehicle 10 is illustrated. Vehicle 10 is preferably a conventional truck 12 having a dump bed 14 for transporting various roadway surface patching materials 15, such as asphalt. Vehicle 10 includes a pair of steerable front rubber tires 16 along with at least one pair of rear rubber road tires 18, which are typically the drive wheels of a road maintenance vehicle. In other embodiments, the front wheels can either be the lone motive wheels (i.e., a front wheel drive) or work in combination with the rear wheels (i.e., in an all-wheel drive configuration). Under normal road operation, the front and rear tires 16, 18 bear the weight of the vehicle as it travels down the roadway.

In addition to the typical components found upon a conventional truck, vehicle 10 includes a pair of surface patching roller assemblies 20, 22 mounted to the frame 24 of the truck. A compression plate 25 is also mounted to the frame 24, in the embodiment illustrated, the compression plate 25 is mounted to the front end of the truck.

Figure 2:
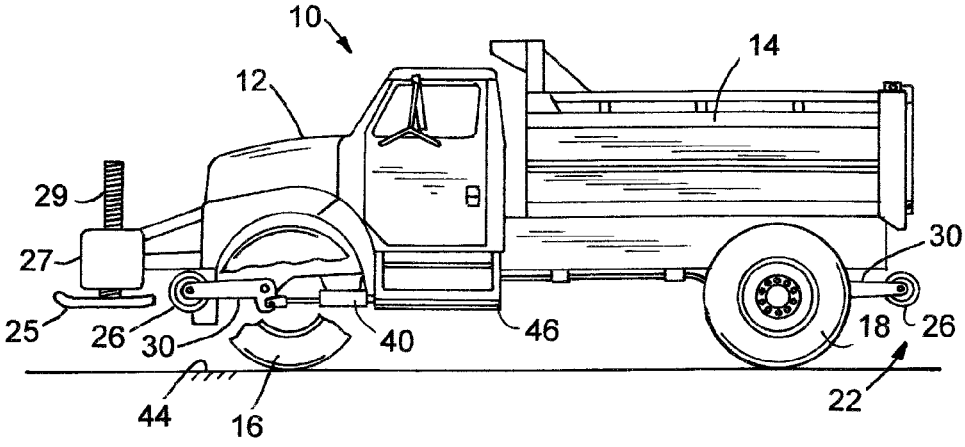
FIG. 2 is a side plan view illustrating the road maintenance vehicle embodying the invention with the roller assemblies stowed.

Referring now to FIGS. 1 and 2, there is shown side view of the vehicle 10. In this exemplary view, a hydraulic actuator (cylinder), motor, or pneumatic cylinder 27 is mounted to the front of vehicle 10. Hydraulic actuator (cylinder) 27 having a movable piston 29 that translates linearly when activated in the directions of arrow 31. In one non-limiting example, piston 29 is a threaded shaft cooperating with a rotating motor 27 to translate linearly in and out of the motor. The end of piston 29 is coupled to an enlarged, substantially flat and rigid compression plate 25, such that when the hydraulic actuator 27 moves, the compression plate 25 is raised and lowered with the piston 29. Actuator 27 is movable from: 1) a deployed position where the compression plate 25 abuts the ground 44; to 2) a stowed position, shown in FIG. 2, where the plate 25 is upwardly suspended relative to the ground 44.

Figure 10:
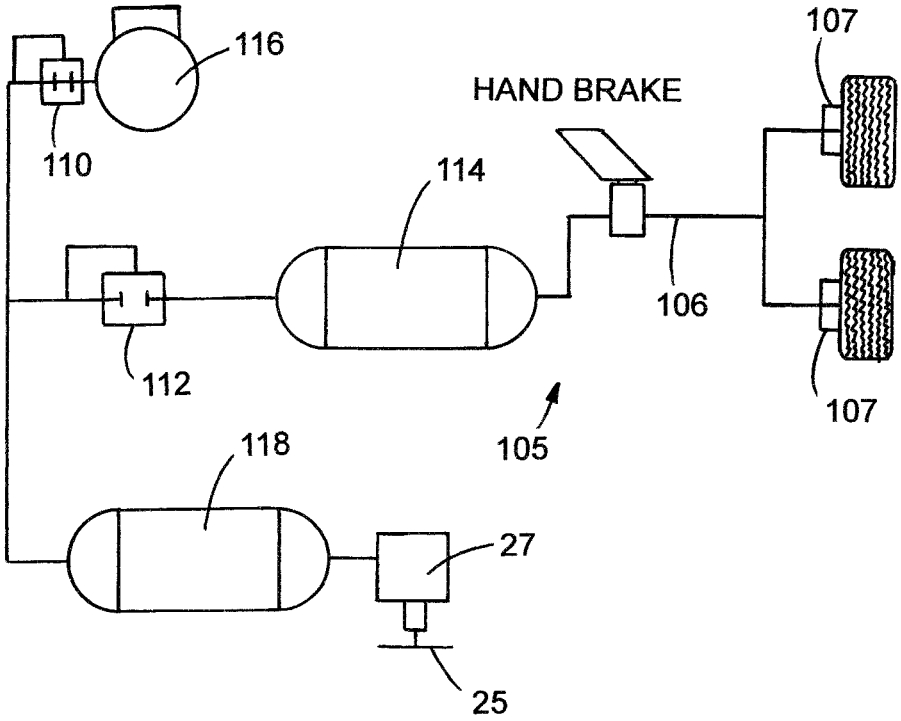
FIG. 10 is a schematic view of a pneumatic embodiment incorporated into a vehicle air braking system.

As shown in FIG. 10, when using air to operate cylinder 27 (pneumatic), the cylinder 27 can be tied into the vehicle's air brake system 105 if present with an air line 106 running through the vehicle's wheel brakes 107. In the embodiment illustrated, there are two pressure regulators 110, 112. The first regulator 110 regulates the whole pneumatic system, which is set at a higher rate than the braking system 105. This is because higher pressure is needed to rapidly move the cylinder 27 to tamp with plate 25.

The second regulator 112, regulates pressure at a lower rate or same as the braking system 105. If air or pressure is needed, the air cylinder tank 114 will then back up the brake system, the brake system is always active, the compressor 116 will then stay on until pressure has been stabilizes. To ensure continuous operation, the compressor 116 may have a fly wheel (not shown) on it, which is turned by the engine. A second air tank 118 ensures that the cylinder 27 has a ready source of pressurized air available.

The hydraulic actuator 27 are coupled to and powered by at least one conventional hydraulic pump 46, which is preferably powered by the vehicle's prime mover (not shown).

Figure 3:
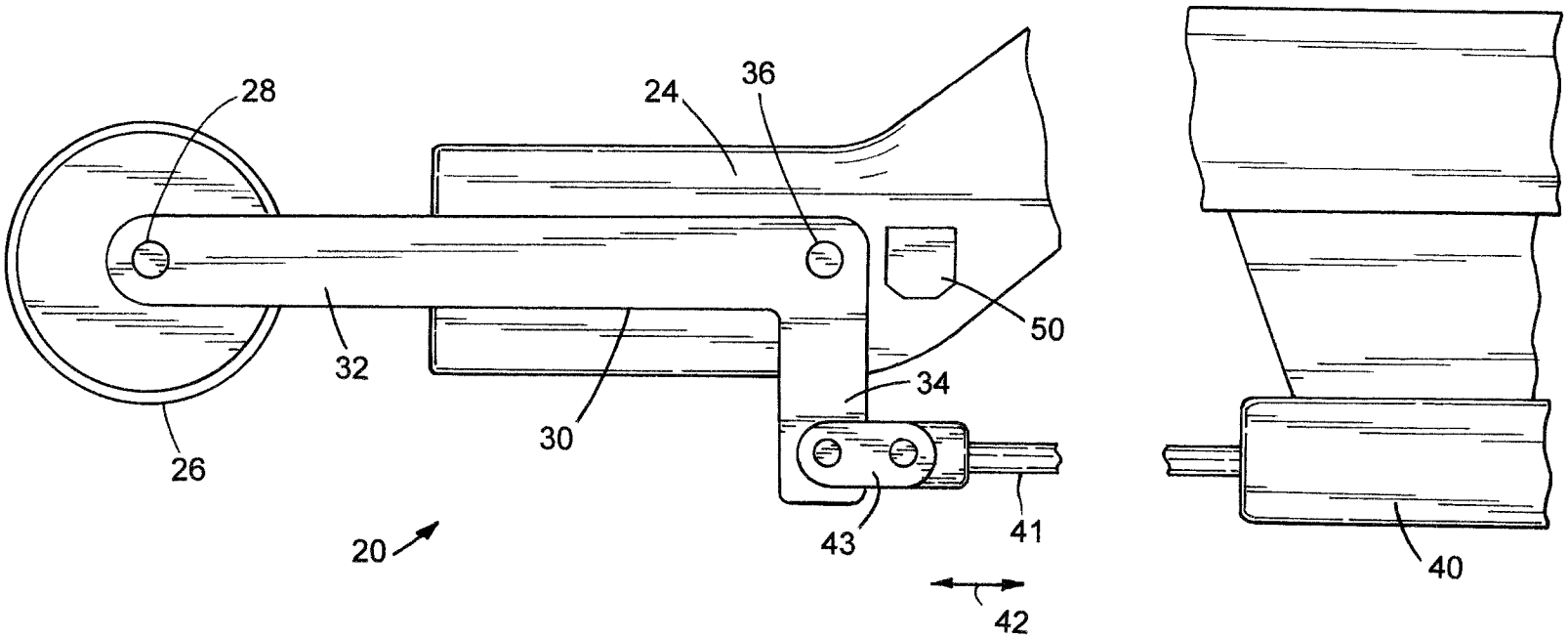
FIG. 3 is a partial side view of one roller assembly in a stowed position.
Figure 4:
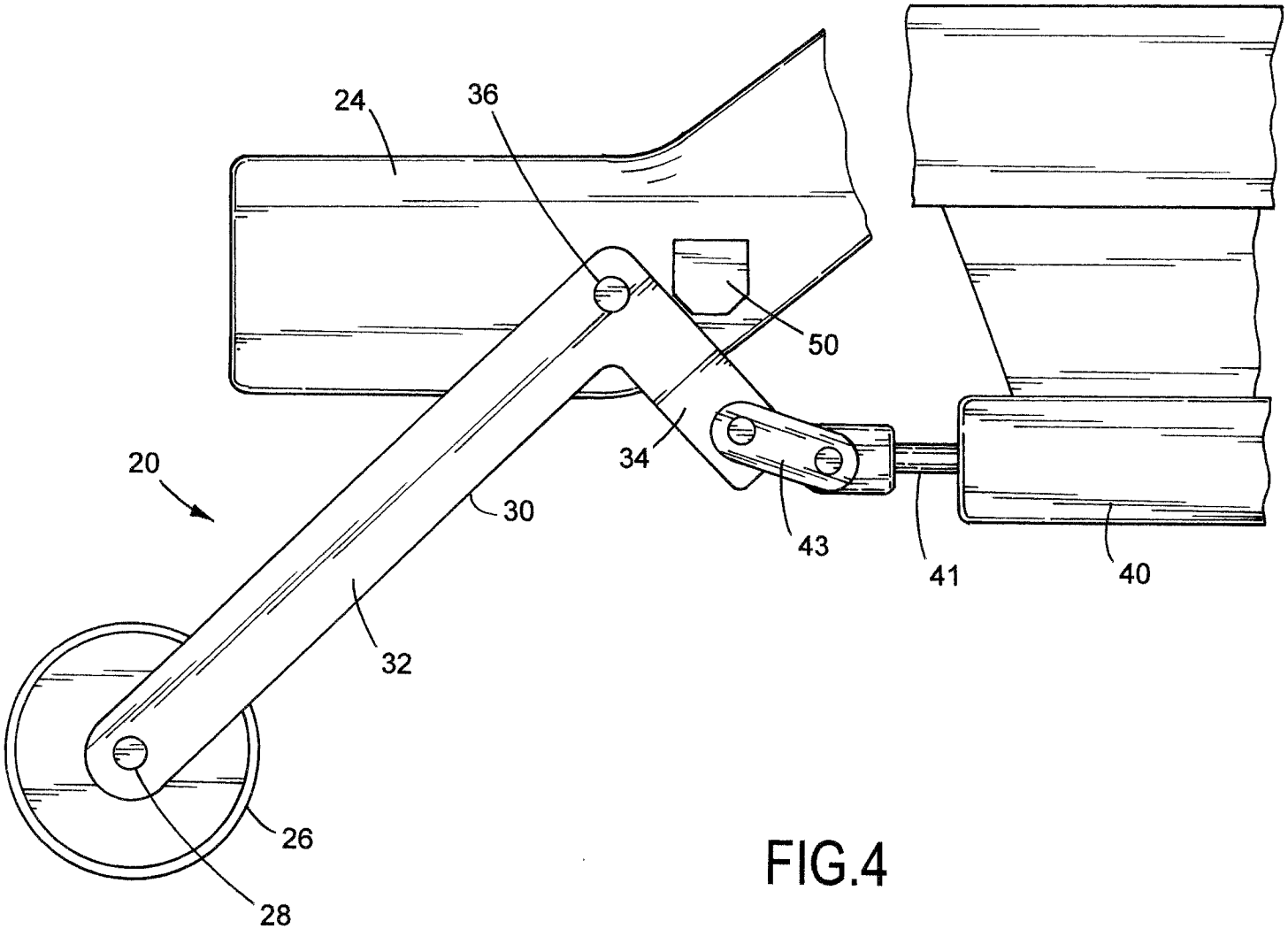
FIG. 4 is a partial side view of the roller assembly of FIG. 3 in a deployed position.
Figure 5:
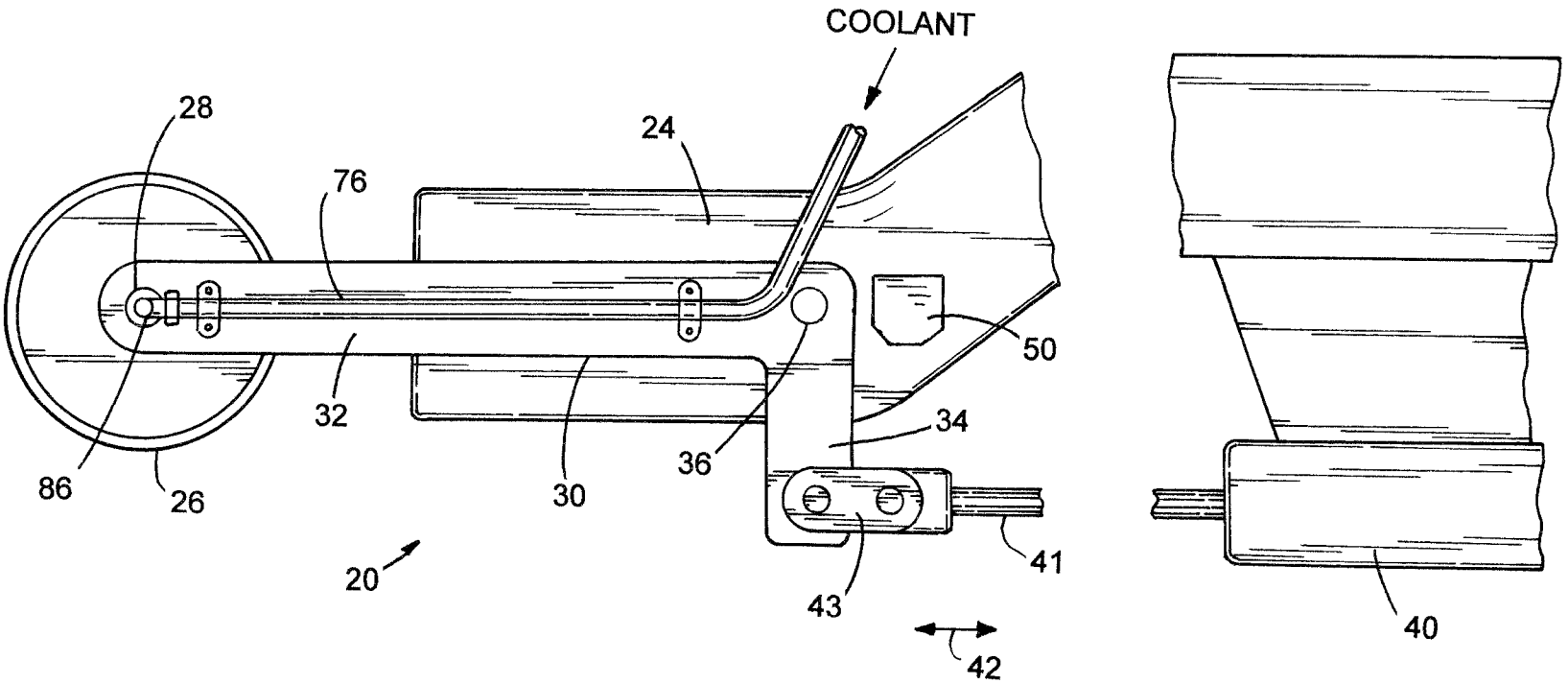
FIG. 5 is a partial side view of one roller assembly with engine coolant lines.

Referring now to FIGS. 3 and 4, there is shown an enlarged partial side view of the front roller assembly 20 of vehicle 10. It should be appreciated that the operation of the front roller assembly 20 and rear roller assembly 22 are substantially the same. Rather than describe identical components and operations in this disclosure, only the front roller assembly 20 will be discussed in detail, with the understanding that one skilled in the relevant art should be able to take the following disclosure related to front roller assembly 20 and apply those teachings to the rear roller assembly 22.

Roller assembly 20 includes an elongated rigid cylindrical roller 26 that is rotatable about a central axle 28. The roller 26 is rotatably supported by a pair of spaced pivot arms 30, which are rotatably coupled to axle 28 at each end of the cylindrical roller 26. In the embodiment illustrated in the FIGS., pivot arm 30 has a general L-shape with an elongated roller leg 32 depending from the end of a mounting leg 34. Each pivot arm 30 is also rotatably secured to frame 24 at a pin 36.

Roller assembly 20 also includes a hydraulic actuator or motor 40 having a movable piston 41 that translates linearly when activated in the directions of arrow 42. In one non-limiting example, piston 41 is a threaded shaft cooperating with a rotating motor 40 to translate linearly in and out of the motor. The end of piston 41 is coupled to at least one of the arms 30 by a pinned linkage 43 such that when the hydraulic actuator 40 moves, the arm 30 pivots about pin 36 to raise and lower the roller 26. As shown in FIGS. 1 and 4, actuator 40 is movable from: 1) a deployed position where the roller 26 abuts the ground 44; to 2) a stowed position, shown in FIGS. 2 and 3, where the roller 26 is upwardly suspended relative to the ground 44.

The hydraulic actuators 40 are coupled to and powered by at least one conventional hydraulic pump 46, which is preferably powered by the vehicle's prime mover (not shown).

Referring back to FIGS. 3 and 4, each roller assembly (i.e., both roller assemblies 20 and 22) further preferably includes a bumper or positive stop 50 which is fixed upon the frame 24 to limit the movement of pivot arms 30. In the preferred embodiment of the invention, the positive stop 50 corresponding to the front roller assembly 20 is located along frame 24 to limit the movement of pivot arm 30 and its roller 26 such that the bottom edge of front roller abuts the ground 44, but does not lift the vehicle 10. That is, the front roller assembly 20 bears little to no weight of the vehicle 10. Instead, the front tires 16 are left upon the ground to allow vehicle 10 to be steered as a conventional motor vehicle.

In this preferred embodiment, the positive stop of the rear roller assembly 22 is positioned relative to the pivot arm to allow the roller of rear roller assembly 22 to not only abut the ground 44, but to bear a portion of the vehicle's weight when in the deployed position shown in FIGS. 1 and 4. Importantly, the rear roller assembly 22 is only permitted to accept some of the weight typically borne by the rear tires 18 to ensure that the drive tires 18 continue to provide motive force for the vehicle. For example and without limitation, the rear roller assembly 22 may be movable approximately one to three inches beyond the vertical limit of front roller assembly 20 to allow some of the vehicle's weight to be applied by the rear roller to aid in compacting any patching material 15.

It should be appreciated that the above described differences in allowable vertical displacement of the front and rear roller assemblies 20, 22 enables the present invention to initially smooth and spread patching material 15 placed upon/within a pothole or crack 62 with the front roller assembly 20. That now-spread material 15 is then compacted by the weight-bearing rear roller assembly 22 as the vehicle 10 drives over the pothole 62 receiving the patching material.

Referring now to FIGS. 5-9 an alternate embodiment of a road maintenance vehicle 10 is illustrated. In this embodiment, at least one of the two roller assemblies 20, 22 include a heating system 70 which transfers coolant heated by the vehicle's engine 71 from the vehicle's engine cooling system, e.g., radiator 72, through the roller or rollers 26 to heat the exterior surface of the roller(s). As has been mentioned prior, the following description will be focused on the front roller assembly 20 with the continued understanding that these teachings can be applied to the rear roller assembly 22 by one skilled in the relevant art.

Figure 6:
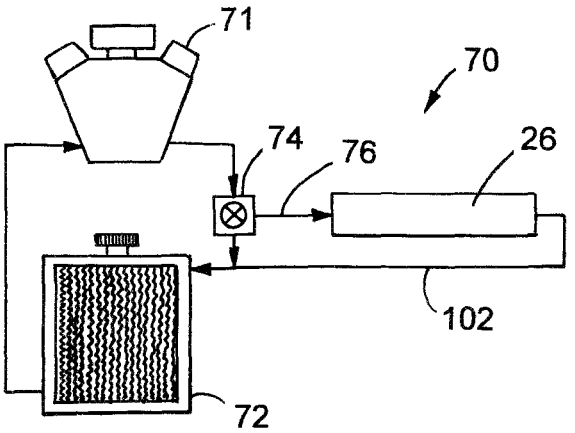
FIG. 6 is a diagram showing the engine coolant routed through the roller assembly.

As shown in FIG. 6, the roller heating system 70 includes an electric pump 74 that is fluidly coupled to the vehicle's engine cooling system, preferably prior to the point where engine-heated coolant enters the radiator 72. In this manner, the coolant will be at its highest temperature when pump 74 re-routes the fluid through conduit 76 to the roller 26.

Figure 7:
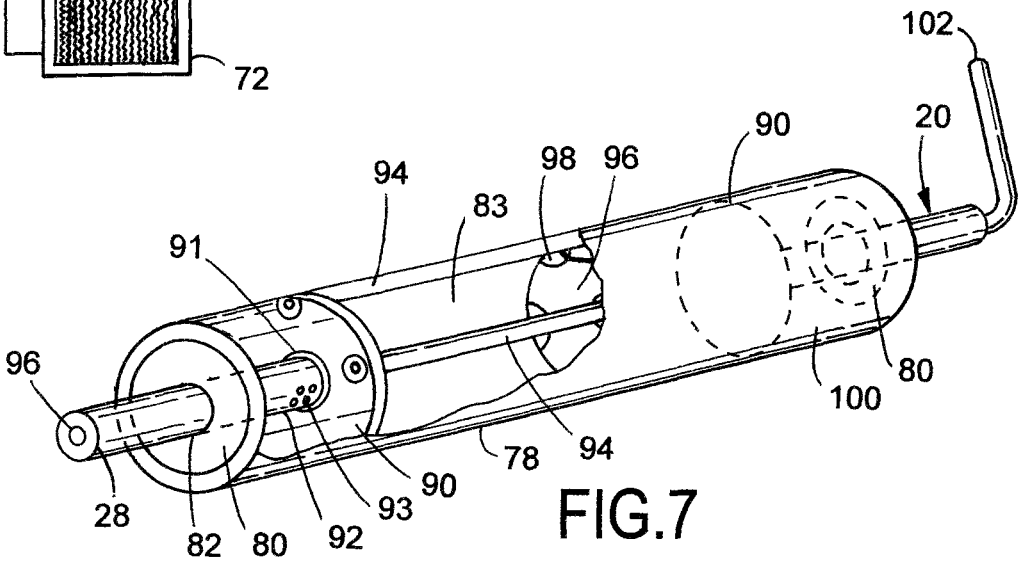
FIG. 7 is a perspective view of a roller having heating tubes passing through an internal cavity.
Figure 8:
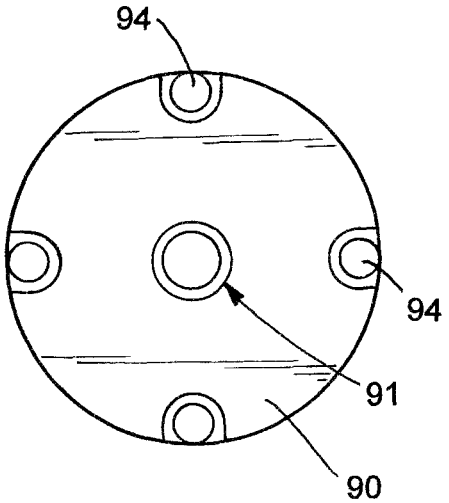
FIG. 8 is a top plan view of a containment wall which distributes the heated coolant fluid through lines running through roller.
Figure 9:
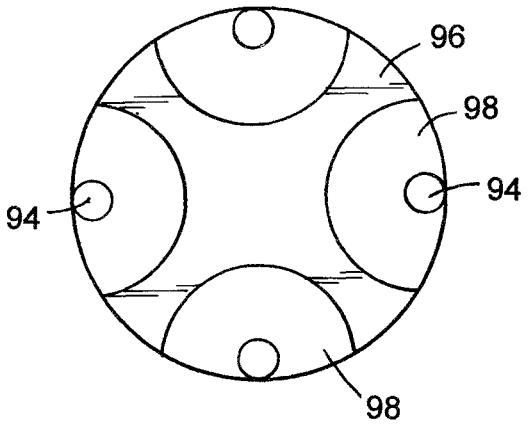
FIG. 9 is a top plan view of a support web mounted within the roller.

Referring now to FIGS. 7-9, roller 26 is this embodiment is a cylindrical tube having a rigid outer wall 78. The two ends of the roller tube are enclosed by end caps 80. End caps 80 each include a water-tight roller bearing 82 in its center. Axle 28 passes through bearing 82 into the central cavity 83 of the roller tube. In this embodiment, axle 28 is also tubular having a central bore 84 which receives a fitting 86 which couples the conduit 76 to the axle 28.

The axle 28 is further supported by a manifold wall 90 contained within cavity 83 proximate to the end cap 80. As shown in FIG. 9, manifold wall 90 includes a second water-tight bearing 91 that receives and rolls upon the end of the axle 28. The radially outer edges of wall 90 seal off the inner portion of the cavity to form a small distribution chamber 92. At least one hole 93 in the axle 28 allows fluid passing through the axle 28 to enter and fill chamber 92. A plurality of elongated tubes 94 are fluidly mounted through the radially outer portion of the wall 90 allowing coolant that fills chamber 92 to pass through the roller.

Each tube 94 is adjacent to, and preferably in direct contact with the inner face of the roller wall 78. The tubes 94 are also preferably evenly spaced about the roller wherein the heat from the fluid passing through the tube 94 is transferred evenly to the roller's outer wall 78.

Additional support webs 96 may be placed within cavity 83 to further support the tubular wall 78. Each web 96 includes a cut-out 98 which allows the elongated tubes 94 to freely pass therethrough.

At the opposing end of the roller 26, another manifold wall 90 cooperates with a second end cap 80 to form a small collection chamber 100 which is fluidly coupled to a second axle 28. A conduit 102 returns the coolant back to the radiator 72, preferably just downstream of where the heating system 70 is coupled to the vehicle's cooling system.

It should be appreciated that through this heating system 70, the present invention takes advantage of the latent heat in the engine cooling system of the vehicle 10 to heat the roller 26 while also reducing the burden on the engine's cooling system by drawing some of the heat into the rollers.

Figure 11:
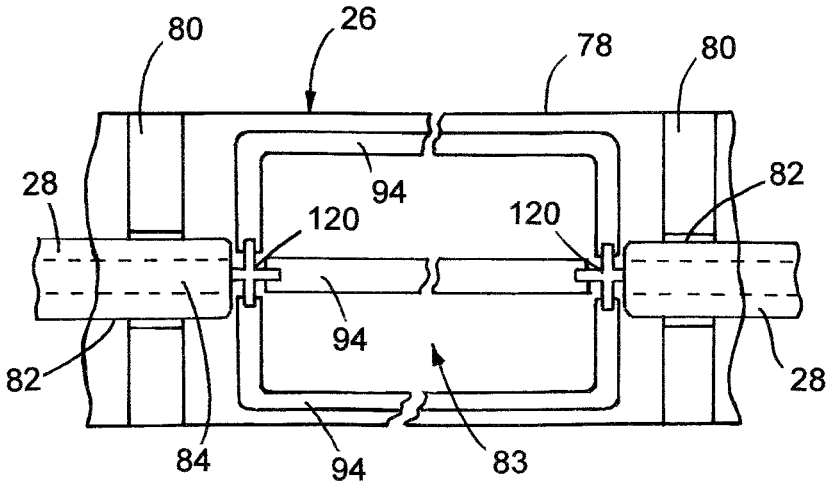
FIG. 11 is an alternate embodiment of the heating system 70'.

Referring now to FIG. 11, an alternate embodiment of the heating system 70' is illustrated. In this embodiment, the heated fluid handling system remains substantially stationary within the rotating roller 26. As the roller 26 turns because of the water tight bearing 82. The end of axle shaft 28 has a threaded cross fitting mount 120 at both ends inside the roller. With the cross fittings 120 there are a plurality, e.g., three (3), connections for tubes 94. Tubes 94 are in close proximity to the roller's inner wall while remaining separate to allow free rotation of the roller. As the heated fluid flows thru, the heat is released to the roller, then returns to the engine cooling system completing the closed loop system.

From the foregoing description, one skilled in the art will readily recognize that the present invention is directed to an improved road maintenance vehicle having a movable compression plate and a pair of selectively deployable rollers. The paired rollers cooperate to initially flatten and then compact a road patching material. The two rollers are mounted adjacent to the front and rear wheels and are hydraulically movable from: 1) a stowed position in which the rollers are remote from the ground; to 2) a deployed position, where the rollers are lowered to the ground. The compression plate providing an additional means for compressing patching material. While the present invention has been described with particular reference to various preferred embodiments, one skilled in the art will recognize from the foregoing discussion and accompanying drawings that changes, modifications, and variations can be made in the present invention without departing from the spirit and scope thereof.

The invention claimed is:

1. A road maintenance vehicle including a vehicle having front and rear rubber road tires supported by a chassis with a vehicle frame, comprising:

a front and rear metal roller assemblies which are pivotally supported by the vehicle frame, each roller assembly having a rigid cylindrical roller which is movable from a stowed position where the roller is upwardly suspended from the ground to a deployed position where the roller is against the ground;

a roller heating system for drawing heated coolant fluid passing through the vehicle's engine through at least one of the metal roller assemblies;

wherein each of the rollers spans the vehicle frame.

2. A road maintenance vehicle as defined in claim 1, wherein the rear roller assembly is deployable vertically downward beyond the front roller assembly when both of the roller assemblies are in their deployed position.

3. A road maintenance vehicle as defined in claim 2, wherein the deployed position of the rear roller assembly is such that a portion of the weight of the vehicle is borne by the rear roller assembly, whereby a compressive force is applied by the rear roller upon road patching materials.

4. A road maintenance vehicle as defined in claim 2, comprising hydraulic actuators coupled to each of the front and rear roller assemblies and selectively move the roller assemblies between the stowed and deployed positions.

5. A road maintenance vehicle as defined in claim 1, wherein the front metal roller assembly is mounted adjacent to the front road tires and the rear metal roller assembly is mounted adjacent to the rear road tires.

6. A road maintenance vehicle as defined in claim 1, wherein each metal roller assembly coupled to said roller heating system is tubular, wherein said roller heating system includes elongated conduits running within a central cavity of said tubular roller proximate to an inner wall of said roller.

7. A road maintenance vehicle as defined in claim 6, wherein said tubes rotate within said roller and are in direct contact with said inner wall.

8. A road maintenance vehicle as defined in claim 6, wherein said tubes are stationary relative to the rotating roller.

9. A road maintenance vehicle as defined in claim 1, wherein said vehicle includes a pneumatic road wheel braking system which operates at a first pressure, comprising:

pneumatic means for raising and lowering said roller assemblies;

an air compressor which supplies pressurized air to the braking system and pneumatic means;

a first pressure regulator which regulates pressure to both the braking system and pneumatic means and which is set at a second higher pressure than the braking system first pressure;

a first air tank that receives and stores air at said second higher pressure;

a second air tank that receives and stores air at said first pressure; and a second pressure regulator which regulates the air pressure to said second air tank at said first pressure.

* * * * *